US006056463A

United States Patent [19]

Nishio et al.

[11] Patent Number: 6,056,463

[45] Date of Patent: May 2, 2000

[54] AQUEOUS BALLPOINT PEN REFILL AND PROCESS FOR PRODUCING THE SAME

[75] Inventors: Akane Nishio; Koji Matsuo; Shinko Mukoda; Koichi Murakawa, all of Tokyo, Japan

[73] Assignee: The Sailor Pen Co. Ltd., Tokyo, Japan

[21] Appl. No.: 09/340,829

[22] Filed: Jun. 28, 1999

[30] Foreign Application Priority Data

Jul. 8, 1998 [JP] Japan ..... 10-207113

[51] Int. Cl.[7] ..... B43K 7/00

[52] U.S. Cl. ..... 401/47; 401/209

[58] Field of Search ..... 401/47, 194, 209

[56] References Cited

U.S. PATENT DOCUMENTS

| | | | |
|---|---|---|---|
| 2,427,033 | 9/1947 | Wahl | 401/47 |
| 2,642,042 | 6/1953 | Gowland | 401/47 |
| 3,094,105 | 6/1963 | Jenkins | 401/47 |
| 4,604,139 | 8/1986 | Shioi et al. | 106/23 |
| 4,966,205 | 10/1990 | Tanaka | 141/9 |
| 5,307,654 | 5/1994 | Gick et al. | 401/47 |
| 5,383,736 | 1/1995 | Okulov | 401/47 |
| 5,636,932 | 6/1997 | Kuo | 401/47 |
| 5,785,746 | 7/1998 | Kito et al. | 401/209 |

FOREIGN PATENT DOCUMENTS

| | | | |
|---|---|---|---|
| 656706 | 8/1961 | Italy | 401/194 |

*Primary Examiner*—Charles R. Eloshway

*Attorney, Agent, or Firm*—Frishauf, Holtz, Goodman, Langer & Chick, P.C.

[57] ABSTRACT

There are provided an aqueous ballpoint pen refill which can produce tasteful writings or drawings with a plurality of colors and which gives an attractive impression, since the inks in the ink reservoir constitute an interesting pattern and also a process for producing the same. A plurality of aqueous inks Ia and Ib with different colors are charged into an ink reservoir having a point tip at the front end to form a vertical or horizontal layered structure or a spiral structure; the aqueous inks containing pigments as coloring agents respectively and each having a viscosity of 45 mPa·S or more; the specific gravity difference of the inks being not more than 0.05. Injection needles connected respectively to front ends of a plurality of ink tanks are inserted to the transparent ink reservoir, and the plurality of inks with different colors are injected while the injection needles are drawn out of the ink reservoir.

3 Claims, 2 Drawing Sheets

AQUEOUS BALLPOINT PEN REFILL AND PROCESS FOR PRODUCING THE SAME

BACKGROUND OF THE INVENTION

The present invention relates to an aqueous ballpoint pen refill having an aqueous ink charged directly in an ink reservoir and also to a process for producing the same.

DESCRIPTION OF THE RELATED ART

Many of conventional aqueous ballpoint pens containing refills in the barrel are of the absorbent type, in which an absorbent formed by bundling extra fine fibers into the form of strand is housed in a refill tube and is impregnated with an aqueous ink to feed the ink contained in the absorbent to a ball of a point tip connected to the tip of the tube. However, the absorbent type aqueous ballpoint pen involves a problem in that the amount of ink absorbed by the absorbent is small to have a limited distance of writing. Further, the ink absorbed by the absorbent cannot be fed completely to the ball of the point tip but remains some in the absorbent, so that it is difficult to know the endpoint where the ink is used up to make writing impossible.

For such reasons, the absorbent type aqueous ballpoint pens are now being replaced mainly by direct ink type aqueous ballpoint pens. The direct ink type aqueous ballpoint pen is loaded in its transparent barrel with a refill prepared by filling a transparent ink reservoir directly with an aqueous ink and sealing the tail end of the aqueous ink with a grease-like counterflow preventing material. The direct ink type aqueous ballpoint pen enjoys merits in that it provides a longer writing distance, since the former can contain a large amount of ink compared with the absorbent type and that it is easy to know the end point since the ink is visible directly through the barrel.

Since writing instruments are very popular goods utilized by anybody in the daily life, they are sometimes expected much to have attractive appearance and to be full of charm. However, the conventional aqueous ballpoint pens use mono color inks such as of black, blue, red and the like respectively, and matters written with them show monotonous appearance. Although the ink is visible directly through transparent barrel and the transparent ink reservoir, this is to confirm the residual amount of the ink and not to show a pattern formed by colors of inks, giving no attractive impression.

SUMMARY OF THE INVENTION

Therefore, it is an objective of the present invention to provide an aqueous ballpoint pen which produces writings or drawings with a plurality of colors or writings or drawings whose ink color changes during writing or drawing and which gives an attractive impression, since the inks in the ink reservoir constitute an interesting pattern, as well as, to provide a process for producing the same.

In order to attain the above objective, the aqueous ballpoint pen refill according to the present invention comprises a transparent ink reservoir having a point tip at the front end; and a plurality of aqueous inks with different colors charged in the ink reservoir to form a vertical or horizontal layered structure or a spiral structure; the aqueous inks containing pigments as coloring agents respectively and each having a viscosity of 45 mPa·S or more; the specific gravity difference of the inks being not more than 0.05.

The process for producing an aqueous ballpoint pen refill comprises inserting injection needles connected respectively to front ends of a plurality of ink tanks of an ink injector to a transparent ink reservoir having a point tip at the front end; and injecting a plurality of inks with different colors while the injection needles are drawn out of the ink reservoir to form a vertical or horizontal layered structure or a spiral structure; the aqueous inks containing pigments as coloring agents respectively and each having a viscosity of 45 mPa·S or more; the specific gravity difference of the inks being not more than 0.05.

Further, in this process, if a plurality of aqueous inks of different colors are injected into the ink reservoir with the ink reservoir or the injection needles being rotated, the inks can easily be injected spirally.

Other aspects and advantages of the invention will become apparent from the following description, taken in conjunction with the accompanying drawings illustrated by way of examples the principles of the invention.

BRIEF DESCRIPTION OF THE DRAWINGS

The invention together with the objects and advantages thereof, may best be understood by reference to the following description of the presently preferred embodiments together with the accompanying drawings in which.

DETAILED DESCRIPTION OF THE PREFERRED EMBODIMENTS

When a plurality of aqueous inks with different colors are charged into an ink reservoir, the inks usually diffuse to be mixed with each other. However, the present inventors found that such diffusion and mixing of inks do not occur even if a plurality of inks with different colors are charged laminally or spirally into an ink reservoir, provided that pigments are used as coloring agents of the aqueous inks, that the aqueous inks have viscosity values of 45 mPa·S or more and that the specific gravity difference of the inks is within 0.05. They also found that the inks in the ink reservoir are maintained in the layered or spiral state to present an interesting pattern and give attractive impression and produce writings or drawings with a plurality of colors or writings or drawings whose ink colors change during writing or drawing, and they accomplished the present invention.

Titanium oxide and aluminum powders and pearlescence pigments are ink components having great specific gravity values. While aqueous inks having viscosity values of 45 mPa·S or more can be obtained by adding these pigments together with a thickening agent, beautiful inks, i.e., a pastel-like ink, a metallic ink and a nacreous ink can be obtained by adding a titanium oxide powder, an aluminum powder and a pearlescence pigment, respectively. Meanwhile, titanium oxide, aluminum powders and pearlescence pigments are pigments having high hiding powers, the boundaries between the inks with different colors charged in the ink reservoir are clarified neatly, and also boundaries between the ink colors in the writing or drawing are clarified to enable writing and drawing of letters and pictures tastefully.

Figure 1A:
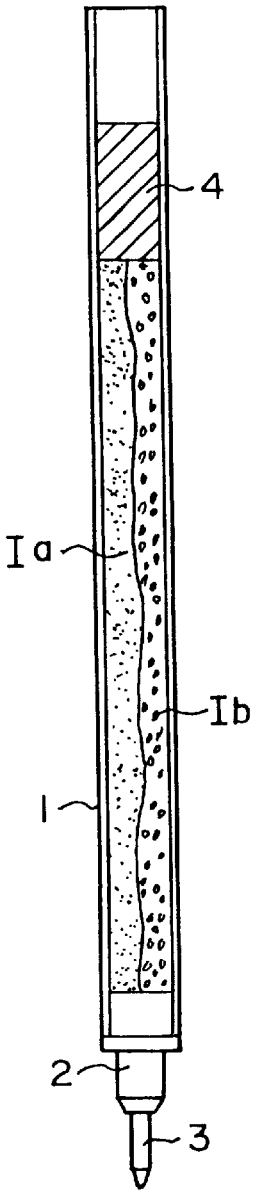
FIG. 1A is an explanatory drawing showing an aqueous ballpoint pen refill according to one embodiment of the present invention.

FIG. 1A shows the embodiment of the invention set forth in claim 1. In FIG. 1A, an ink reservoir 1 is prepared by cutting a 4 mm-diameter transparent synthetic resin pipe to a length of about 100 mm, and a bullet-like point tip 3 rotatably holding a ball is connected to the tip opening of the ink reservoir 1 via a joint 2. Two kinds of aqueous inks Ia and Ib with different colors are charged into the ink reservoir 1. A grease-like counterflow preventing material 4 is filled in the ink reservoir 1 on the tail end side of the aqueous inks Ia and Ib to prevent counterflow of the aqueous inks Ia and Ib from the ink reservoir 1. The grease-like counterflow preventing material 4 advances with consumption of the aqueous inks Ia and Ib. An aqueous ballpoint pen refill having the constitution as described above is loaded in a transparent barrel, and the aqueous inks Ia and Ib are fed to the ball of the point tip 3 to enable writing.

The refill may not be loaded in the barrel but may be used as such as an aqueous ballpoint pen.

It should be noted here that the coloring agents for the aqueous inks Ia and Ib are not dyes but pigments, and the aqueous inks Ia and Ib are incorporated with titanium oxide or aluminum powder or a pearlescence pigment respectively and has viscosity values of 45 mPa·S or more. The gravity difference between the aqueous ink Ia and the aqueous ink Ib is not greater than 0.05.

Figure 1B:
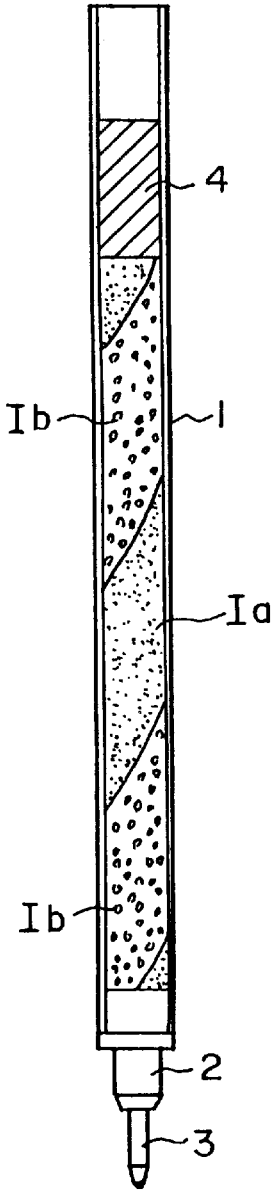
FIG. 1B is an explanatory drawing showing an aqueous ballpoint pen refill according to another embodiment of the present invention.
Figure 1C:
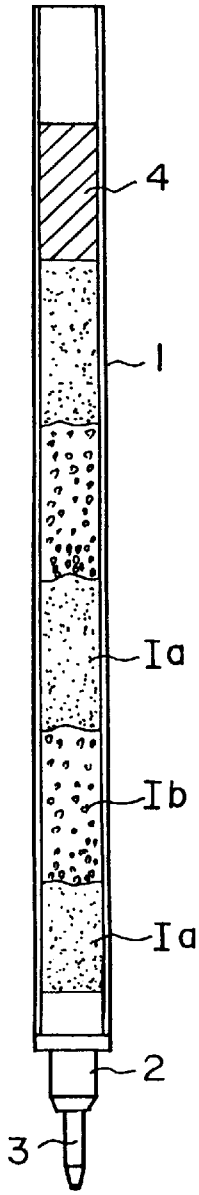
FIG. 1C is an explanatory drawing showing an aqueous ballpoint pen refill according to another embodiment of the present invention.

FIG. 1A shows an example where two kinds of aqueous inks Ia and Ib are charged into the ink reservoir 1 to form a vertical layer structure. FIG. 1B shows an example where aqueous inks Ia and Ib are charged spirally as a variation of the example where the inks Ia and Ib are charged to form a vertical layer structure. Accordingly, in the examples shown in FIGS. 1A and 1B, while matters are written or drawn with these two inks Ia and Ib with different colors simultaneously, tasteful letters or drawing can be obtained with no mixing of these two inks but with clear boundaries. Meanwhile, FIG. 1C shows an example where aqueous inks Ia and Ib are charged to form a horizontal layer structure or are layered alternately. Thus, the ink color changes from that of the aqueous ink Ia to that of the aqueous ink Ib during writing or drawing to present a writing or drawing with tasteful appearance.

In any of the aqueous ballpoint pen refills shown in FIGS. 1A, 1B and 1C, diffusion and mixing of the aqueous ink Ia and the aqueous ink Ib do not occur. The boundary between the aqueous ink Ia and the aqueous ink Ib is clear, and the colors of the inks and the boundary of the inks present an interesting pattern to give an attractive impression.

It should be noted that the aqueous inks to be charged are not to be limited to two, but three or more kinds of aqueous inks with different colors may be charged.

Figure 2A:
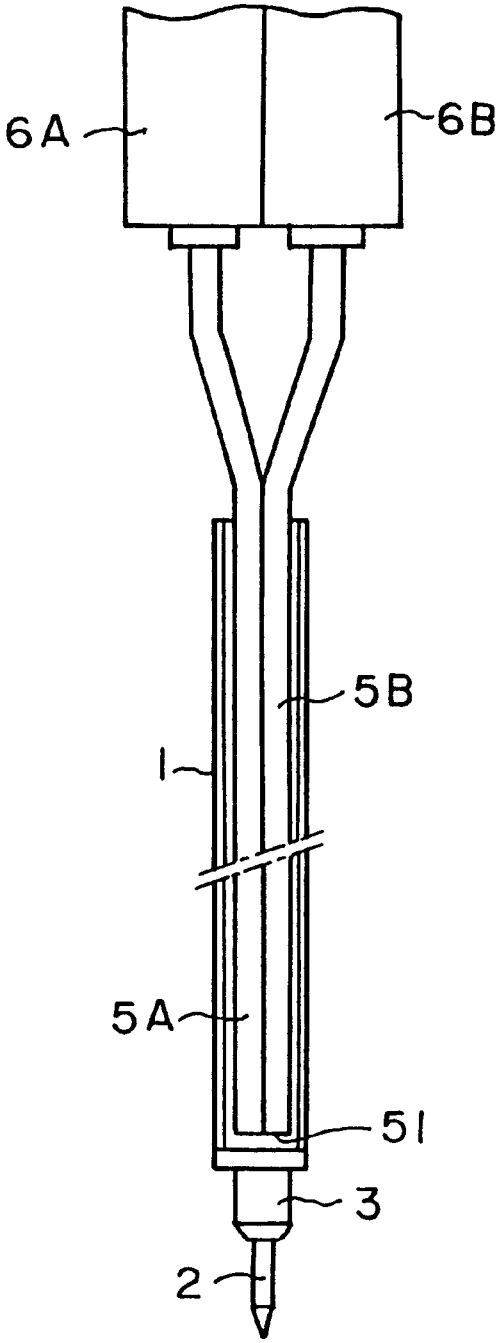
FIGS. 2A and 2B are explanatory drawings showing a process for producing the aqueous ballpoint pen refill according to one embodiment of the present invention.
Figure 2B:
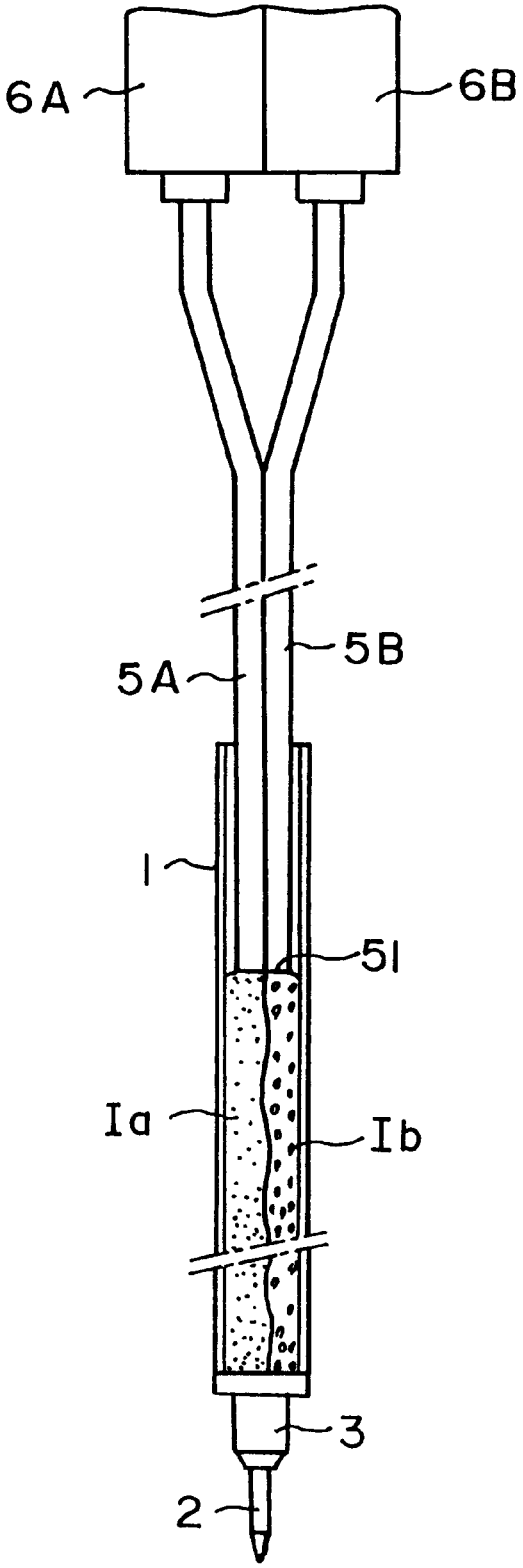

FIGS. 2A and 2B show a process for producing the refill as shown in FIG. 1A. An ink injector has a pair of ink tanks 6A and 6B containing the aqueous inks Ia and Ib, and injection needles 5A and 5B attached to the tanks 6A and 6B, respectively. First, the injection needles 5A and 5B are inserted to the ink reservoir 1 to locate tip openings 51 of the injection needles 5A and 5B at the deep bottom of the ink reservoir 1. The aqueous inks Ia and ab are then injected simultaneously through the injection needles 5A and 5B while they are drawn out of the ink reservoir 1, as shown in FIG. 2A. Thus, two kinds of aqueous inks Ia and Ib are charged into the ink reservoir 1 to form a vertical layer structure, as shown in FIG. 2B. That is, a refill as shown in FIG. 1A can be obtained.

Next, if the ink reservoir 1 or the injection needles 5A and 5B are rotated when the aqueous inks Ia and Ib are injected simultaneously through the injection needles 5A and 5B while they are drawn out of the ink reservoir 1, a refill charged with the aqueous inks Ia and Ib spirally as shown in FIG. 1B can be obtained. Further, if the aqueous inks Ia and Ib are injected alternately into the ink reservoir 1 through the injection needles 5A and 5B while they are drawn up, a refill charged with the aqueous inks Ia and Ib layered horizontally as shown in FIG. 1C can be obtained.

In the examples shown above, two kinds of aqueous inks Ia and Ib are injected into the ink reservoir 1. However, when three or more kinds of aqueous inks with different colors are to be injected into the ink reservoir 1, an ink injector having the same number of ink tanks and the same number of injection needles as that of the aqueous inks may be used.

Seven kinds of inks A1 to A7 as titanium oxide-containing pastel-like inks A; six kinds of inks B1 to B6 as aluminum powder-containing metallic inks B; and six kinds of inks C1 to C6 as pearlescence pigment-containing nacreous inks C were prepared according to the formulations shown in Tables 1, 2 and 3, respectively.

The components added are indicated in terms of part by weight to make up 100 parts by weight in total by adding water. Meanwhile, viscosity was measured using an E-type viscometer and shown in terms of mPa·S unit. Specific gravity was measured using a standard gravimeter.

In Tables 1, 2 and 3, the components are as shown below:

Component 11: SR-1, (titanium oxide, Sakai Kogyo Chemical)

Component 12: LUMINOL NKW (fluorescent pink aqueous pigment, Nippon Keiko Kagaku)

Component 13: LUMINOL NKW (fluorescent blue aqueous pigment, Nippon Keiko Kagaku)

Component 14: PRIMAL MV (acrylic emulsion resin; Rohm and Haas)

Component 15: KERZAN (thickening agent, Sansho K.K.)

Component 16: POIS 840S (dispersant; Kao Corporation)

Component 17: Polyethylene glycol No. 600 (lubricant; Toho Kagaku Kogyo)

Component 18: Glycerol

Component 19: Propylene glycol

Component 21: ALPASTE WXM (55% aluminum powder; Toyo Aluminum)

Component 22: EMACOL NS (yellow aqueous pigment, Sanyo Shikiso)

Component 23: EMACOL NS (blue aqueous pigment, Sanyo Shikiso)

Component 24: JONCRYL 1535 (acrylic emulsion resin; Johnson Polymer)

Component 25: KOHJIN R (thickening agent; Kohjin)

Component 31: IRIODIN 111 (pearlescence pigment, Merck Japan)

Component 32: POIS 530 (dispersant; Kao Corporation)

Component 33: SF5017 (fluorescent yellow aqueous pigment; Sinloihi) Component 34: SF5014 (fluorescent orange aqueous pigment; Sinloihi)

Formulations, viscosity and specific gravity values of the seven kinds of inks A1 to A7 as the titanium oxide-containing pastel-like inks A are shown in Table 1.

TABLE 1

| Component | Ink A | | | | | | |
|---|---|---|---|---|---|---|---|
| | A1 | A2 | A3 | A4 | A5 | A6 | A7 |
| 11 | 25 | 25 | 25 | 25 | 25 | 29 | 35 |
| 12 | 10 | | 10 | 10 | 10 | | |
| 13 | | 10 | | | | 10 | 10 |
| 14 | 25 | 25 | 5 | 10 | 15 | 20 | 5 |
| 15 | 0.3 | 0.3 | 0.7 | 0.3 | 0.3 | 0.3 | 0.3 |
| 16 | 2 | 2 | 2 | 2 | 2 | 2 | 2 |
| 17 | 5 | 5 | | 3 | 3 | 5 | 3 |
| 18 | 7 | 7 | 5 | 5 | 5 | 7 | 5 |
| 19 | 9 | 9 | 5 | 5 | 5 | 9 | 7 |
| Viscosity | 81 | 75 | 35 | 41 | 50 | 88 | 95 |
| Specific gravity | 1.28 | 1.27 | 1.25 | 1.26 | 1.27 | 1.33 | 1.36 |

Formulations, viscosity and specific gravity of the six kinds of inks B1 to B6 as the aluminum powder-containing metallic inks B are shown in Table 2.

TABLE 2

| Component | Ink B | | | | | |
|---|---|---|---|---|---|---|
| | B1 | B2 | B3 | B4 | B5 | B6 |
| 21 | 5 | 5 | 4 | 5 | 15 | 20 |
| 22 | 30 | 20 | 20 | | | |
| 23 | | | | 30 | 20 | 15 |
| 24 | 10 | 6 | 3 | 10 | 5 | 3 |
| 25 | 0.4 | 0.2 | 0.1 | 0.4 | 0.3 | 0.25 |
| 17 | 5 | | | 5 | | |
| 18 | 5 | 5 | 5 | 5 | 5 | 3 |
| 19 | 5 | 5 | | 5 | 5 | 3 |
| Viscosity | 80 | 38 | 30 | 76 | 96 | 110 |
| Specific gravity | 1.26 | 1.24 | 1.23 | 1.25 | 1.32 | 1.36 |

Formulations, viscosity and specific gravity of the six kinds of inks C1 to C6 constituting the pearlescence incorporated with an pearlescence pigment are shown Table 3.

TABLE 3

| Component | Ink C | | | | | |
|---|---|---|---|---|---|---|
| | C1 | C2 | C3 | C4 | C5 | C6 |
| 31 | 15 | 15 | 15 | 15 | 5 | 25 |
| 32 | 1 | 1 | 1 | 1 | 1 | 1 |
| 33 | | | | 20 | 20 | 20 |
| 34 | 20 | 15 | 10 | | | |
| 25 | 0.4 | 0.3 | 0.1 | 0.4 | 0.5 | 0.3 |
| 17 | 5 | | | 5 | 5 | 5 |
| 18 | 10 | 5 | 5 | 10 | 10 | 10 |
| 19 | 5 | | | 5 | 5 | 5 |
| Viscosity | 55 | 40 | 35 | 60 | 71 | 95 |
| Specific gravity | 1.16 | 1.15 | 1.14 | 1.17 | 1.09 | 1.25 |

In Table 1, the inks A1, A3, A4 and A5 are pink inks, and the inks A2, A6 and A7 are blue inks. Combinations of the pink inks and the blue inks as shown in Table 4 were charged into ink reservoirs respectively to observe appearance of each refill after leaving to stand at ambient temperature for 24 hours.

In Table 2, the inks B1, B2 and B3 shown are yellow and the inks B4, B5 and B6 are blue inks. Combinations of the yellow inks and the blue inks as shown in Table 4 were charged into ink reservoirs respectively to observe appearance of each refill after leaving to stand at ambient temperature for 24 hours.

In Table 3, the inks C1, C2 and C3 shown are orange inks and the inks C4, C5 and C6 are yellow inks. Combinations of the orange inks and the yellow inks as shown in Table 4 were charged into ink reservoirs respectively to observe appearance of each refill after leaving to stand at ambient temperature for 24 hours.

Results of observation of refill appearance are shown in Table 4.

TABLE 4

| Ink combination | | Specific gravity difference | Appearance |
|---|---|---|---|
| A1 | A2 | 0.01 | ○ |
| A2 | A3 | 0.02 | X |
| A2 | A4 | 0.01 | X |
| A2 | A5 | 0.00 | ○ |
| A1 | A6 | 0.05 | ○ |
| A1 | A7 | 0.08 | X |
| B1 | B4 | 0.01 | ○ |
| B2 | B4 | 0.01 | X |
| B3 | B4 | 0.02 | X |
| B1 | B5 | 0.06 | X |
| B1 | B6 | 0.10 | X |
| C1 | C4 | 0.01 | ○ |
| C2 | C4 | 0.02 | X |
| C3 | C4 | 0.03 | X |
| C1 | C5 | 0.07 | X |
| C1 | C6 | 0.09 | X |

○: The ink boundary is clear.
X: The ink boundary is blurred.

As can be understood from Table 4, in the combinations of inks containing inks having viscosity values of less than 45 mPa·S (inks A3, A4, B2, B3, C2 and C3) respectively, and even in the combinations of inks having viscosity values of 45 mPa·S or more but having ink specific gravity differences of 0.06 or more, the boundary between the inks in each combination was blurred not to give attractive impression.

On the other hand, in any combination of the inks having viscosity values of 45 mPa·S or more and having ink specific gravity differences of not more than 0.05, the boundary between the inks was clear, and the difference in the color of the inks and the boundary constituted a beautiful pattern to provide an aqueous ballpoint pen having a beautiful appearance and full of charm. When matters are written or drawn using such aqueous ballpoint pens, two kinds of inks with different colors are delivered simultaneously, and thus tasteful letters and drawings can be written or drawn with clear boundaries between the inks using the aqueous ballpoint pens of the present invention.

While combinations of two kinds of inks have been described above, the same results can be obtained using a combination of three or more kinds of inks.

As described above, in the aqueous ballpoint pen refill according to the present invention, a plurality of aqueous inks with different colors are charged into a transparent ink reservoir having at the front end a point tip to form a vertical or horizontal layered structure or a spiral structure; the aqueous inks containing pigments as coloring agents respectively and each having a viscosit y of 45 mPa·S or more; the specific gravity difference of the inks being not more than 0.05. Accordingly, there are provided aqueous ballpoint pen refills, which produce tasteful writings or drawings with a plurality of colors or writings or drawing s whose ink colors change during writing or drawing and which give attractive impression, since the inks in the ink reservoir constitute an interesting pattern.

Meanwhile, the above aqueous ballpoint pen refill can be produced easily by inserting injection needles connected respectively to front ends of a plurality of ink tanks of an ink injector to a transparent ink reservoir having a point tip at the front end; and injecting a plurality of inks with different colors while the injection needles are drawn out of the ink reservoir to form a vertical or horizontal layered structure or a spiral structure; the aqueous inks containing pigments as coloring agents respectively and each having a viscosity of 45 mPa·S or more; the specific gravity difference of the inks being not more than 0.05.

Although only a few embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. An aqueous ballpoint pen refill comprising:

a transparent ink reservoir having a point tip at the front end; and a plurality of aqueous inks with different colors charged in the ink reservoir to form a vertical or horizontal layered structure or a spiral structure; the aqueous inks containing pigments as coloring agents respectively and each having a viscosity of 45 mPa·S or more; the specific gravity difference of the inks being not more than 0.05.

2. A process for producing an aqueous ballpoint pen refill, which comprises:

inserting injection needles connected respectively to front ends of a plurality of ink tanks of an ink injector to a transparent ink reservoir having a point tip at the front end; and injecting a plurality of inks with different colors while the injection needles are drawn out of the ink reservoir to form a vertical or horizontal layered structure or a spiral structure; the aqueous inks containing pigments as coloring agents respectively and each having a viscosity of 45 mPa·S or more; the specific gravity difference of the inks being not more than 0.05.

3. The process for producing an aqueous ballpoint pen refill according to claim 2, wherein the ink reservoir or the injection needles are rotated when the plurality of aqueous inks with different colors are injected into the ink reservoir.

* * * * *